US009909526B2

(12) United States Patent
Schneider

(10) Patent No.: US 9,909,526 B2
(45) Date of Patent: Mar. 6, 2018

(54) MONOBLOC PISTON WITH A LOW FRICTION SKIRT

(75) Inventor: Norbert Schneider, Ann Arbor, MI (US)

(73) Assignee: Federal-Mogul LLC, Southfield, MI (US)

( * ) Notice: Subject to any disclaimer, the term of this patent is extended or adjusted under 35 U.S.C. 154(b) by 726 days.

(21) Appl. No.: 12/869,906

(22) Filed: Aug. 27, 2010

(65) Prior Publication Data

US 2011/0048365 A1 Mar. 3, 2011

Related U.S. Application Data

(60) Provisional application No. 61/237,472, filed on Aug. 27, 2009.

(51) Int. Cl.
*F02F 3/00* (2006.01)
*F02F 3/02* (2006.01)
*F02F 3/22* (2006.01)

(52) U.S. Cl.
CPC ..... *F02F 3/003* (2013.01); *F02F 3/027* (2013.01); *F02F 3/22* (2013.01)

(58) Field of Classification Search
CPC ..... F02F 3/00; F02F 3/02
USPC ..... 123/193.6; 92/158, 212
See application file for complete search history.

(56) References Cited

U.S. PATENT DOCUMENTS 1,351,239 A 8/1920 Flammang
1,408,066 A 2/1922 Berry
4,158,328 A * 6/1979 Beardmore ..... F16J 1/04 123/193.4
4,599,935 A 7/1986 Ellerman et al.
4,674,399 A 6/1987 Bruni
4,715,267 A 12/1987 Richmond
5,076,226 A * 12/1991 Watanabe et al.
5,251,540 A * 10/1993 Rhodes et al. ..... 92/212
5,713,262 A * 2/1998 Sugiyama et al. ..... 92/158
5,934,174 A * 8/1999 Abraham, Sr. ..... B23P 15/10 123/193.6
6,155,157 A * 12/2000 Jarrett ..... 92/186
6,609,490 B2 8/2003 Flinchbaugh et al.
6,923,153 B2 * 8/2005 Rein ..... B22F 5/008 123/193.6
7,472,674 B2 * 1/2009 Robelet ..... 123/193.6
8,042,453 B2 * 10/2011 Azevedo ..... F16J 1/04 92/160

(Continued)

FOREIGN PATENT DOCUMENTS

EP 0050256 4/1982
JP S61162100 A 7/1986
JP 04-076257 A 3/1992

(Continued)

*Primary Examiner* — Marguerite McMahon
*Assistant Examiner* — James Kim
(74) *Attorney, Agent, or Firm* — Robert L. Sterns; Dickinson Wrigt, PLLC

(57) ABSTRACT

A piston for an internal combustion engine has an upper crown portion with a pair of pin bosses depending therefrom, wherein the pin bosses have pin bores axially aligned along a central pin bore axis. A pair of laterally spaced skirt portions are fixedly attached to the pin bosses and depend to a lowermost free edge. At least one of the skirt portions has a recess extending upwardly from the lowermost free edge beyond the central axis of the pin bores.

3 Claims, 3 Drawing Sheets

(56) References Cited

U.S. PATENT DOCUMENTS

| | | | | |
|---|---|---|---|---|
| 2005/0039708 | A1 | 2/2005 | Green | |
| 2010/0139480 | A1* | 6/2010 | Ohmori | F02F 3/00 92/239 |

FOREIGN PATENT DOCUMENTS

| | | | |
|---|---|---|---|
| JP | H0489145 | A | 3/1992 |
| JP | H04244671 | A | 9/1992 |
| JP | H09317554 | A | 12/1997 |
| JP | 10-078130 | A | 3/1998 |
| JP | 2001082246 | A | 3/2001 |

* cited by examiner

MONOBLOC PISTON WITH A LOW FRICTION SKIRT

CROSS-REFERENCE TO RELATED APPLICATIONS

This application claims the benefit of U.S. Provisional Application Ser. No. 61/237,472, filed Aug. 27, 2009, which is incorporated herein by reference in its entirety.

BACKGROUND OF THE INVENTION

1. Technical Field

This invention relates generally to internal combustion engines, and more particularly to monobloc pistons.

2. Related Art

It is known that internal combustion engines, and particularly diesel engines, utilize monobloc construction pistons having a fixed skirt formed as one piece of material with the piston. The skirts typically have a rectangular configuration extending continuously between opposite pin bosses downwardly to a substantially straight bottom edge. Although the skirts are generally effective in guiding the piston within a cylinder bore, they have inherent drawbacks. First, being constructed as a continuous rectangular wall of material, the skirts increase the overall weight of the piston. The increased weight can decrease the useful life of associated components by imparting increased inertial forces thereon, while also reducing the fuel economy of the engine. Further, increased area of the skirts causes friction against the cylinder liner, thereby further reducing the useful life and fuel economy of the engine. In addition to these drawbacks, having a continuous rectangular skirt wall reduces the flexibility of the pin bosses. Accordingly, the pin bosses unable to flex with the wrist pin during a stroke of the piston, and thus, increased friction results in the wrist pin joint and pin bores. Further yet, manufacture of the skirts can prove difficult in that the processes used to form them must provide for precise formation of wall contours and thicknesses over the full skirt area.

Some attempts have been made to reduce the skirt area and weight, including forming skirts with recesses extending from the lower surface upwardly to the pin bore axis, however, these efforts fall short of attaining a maximized reduction in skirt area and weight, and the aforementioned friction issues still remain in large part between the skirt wall and the cylinder bore, and also in the wrist pin joint and pin bore areas.

A monobloc piston manufactured according to the present invention overcomes or greatly minimizes the drawbacks resulting from at least those problems discussed above, thereby allowing engines to operate at an increased performance level, while reducing their fuel consumption, oil consumption and exhaust emissions, besides prolonging their useful life.

SUMMARY OF THE INVENTION

A piston for an internal combustion engine constructed according to one aspect of the invention has an upper crown portion with a pair of pin bosses depending therefrom and having pin bores axially aligned along a central pin bore axis. A pair of laterally spaced skirt portions are fixedly attached to the pin bosses and depend to a lowermost free edge. At least one of the skirt portions has a recess extending upwardly from the lowermost free edge beyond the central axis of the pin bores.

Accordingly to another aspect of the invention, the recess extends upwardly from the lowermost free edge substantially tangent with an uppermost portion of the pin bores.

According to another aspect of the invention, the recess is generally U-shaped.

According to another aspect of the invention, the skirt portion on the thrust side of the piston has a recess and the skirt portion on the anti-thrust side of the piston does not have a recess.

According to another aspect of the invention, both the skirt portions have recesses.

It is contemplated that pistons manufactured in accordance with the present invention will exhibit improved oil flow over a complete cycle of the piston, reduce dynamic viscous friction over the cycle of the piston, improve the guidance of the piston throughout its complete cycle, reduce cylinder liner cavitation, reduce piston viscous friction loss, reduce carbon build-up in ring grooves of the piston and on piston rings within the grooves, enhance flexibility of the pin bosses, reduce friction in the wrist pin joint and pin bores, improve the movement of the piston rings, reduce oil consumption and formed carbon adhered to the top land, thereby reducing bore polishing typically caused by carbon build-up, reduce exhaust emissions, and overall improve the running performance and life of the engine. The sum of these beneficial effects reduces engine fuel consumption and promotes more miles-to-gallon.

BRIEF DESCRIPTION OF THE DRAWINGS

These and other aspects, features and advantages of the invention will become readily apparent to those skilled in the art in view of the following detailed description of the presently preferred embodiments and best mode, appended claims, and accompanying drawings, in which:

DETAILED DESCRIPTION OF PRESENTLY PREFERRED EMBODIMENTS

Figure 5:
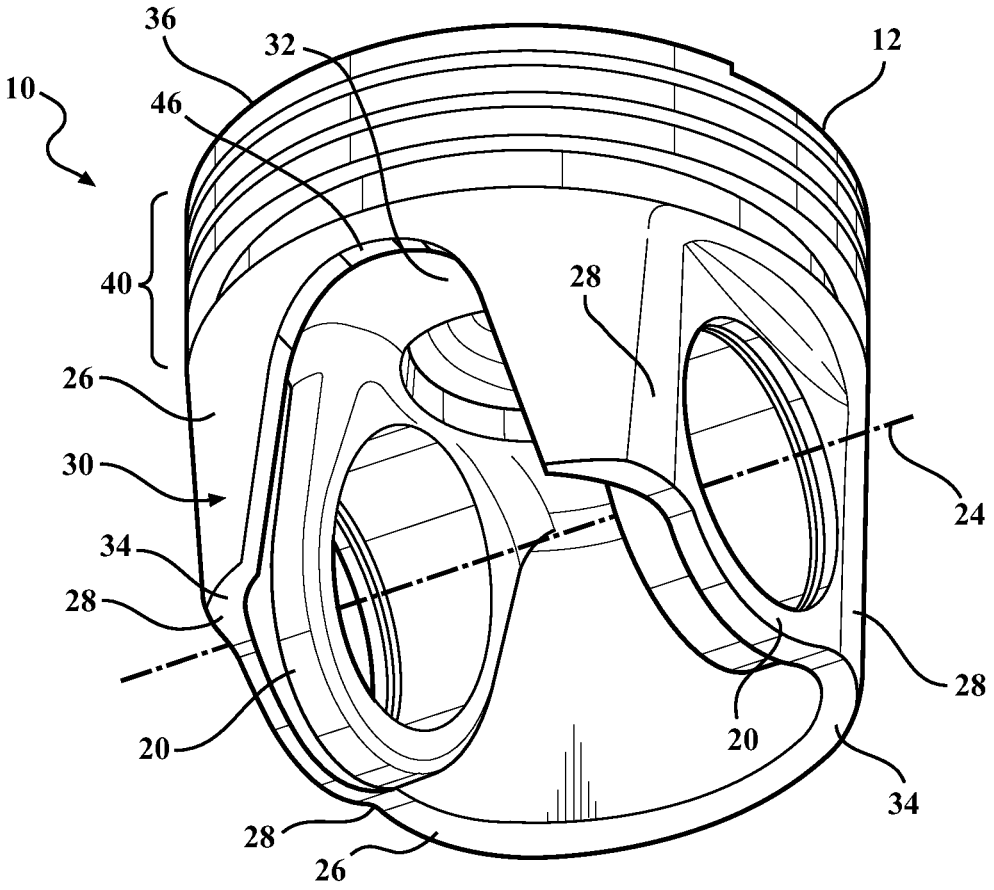
FIG. 5 is a view similar to FIG. 4 of a piston constructed according to another presently preferred embodiment of the invention.

Referring in more detail to the drawings, FIGS. 1-4 illustrate a piston 10 constructed according to one presently preferred embodiment of the invention for reciprocating movement in a cylinder bore (not shown) of an internal combustion engine, such as a heavy duty diesel engine, for example. The piston 10 has a body 12, either cast or forged, or by any other process of manufacture, extending along a central longitudinal axis 14 along which the piston 10 reciprocates in the cylinder bore. The body 12 is represented, by way of example and without limitation, as having an upper crown 16 joined to a lower crown 18. The lower crown 18 has a pair of pin bosses 20 depending therefrom to provide laterally spaced pin bores 22 aligned along a pin bore axis 24 that extends generally transverse to the central longitudinal axis 14. The pin bosses 20 are joined to laterally spaced skirt portions 26 via strut portions 28. The skirt portions 26 are diametrically spaced from one another across the pin bore axis 24 and have convex outer surfaces 30 contoured for cooperation with the cylinder bore to maintain the piston 10 in a desired orientation as it reciprocates through the cylinder bore. During reciprocation, a hydrodynamic oil film is developed and maintained between the outer surfaces 30 of the skirt portions 26 and the wall of the cylinder bore to minimize dynamic friction therebetween. To enhance the performance and maximize the useful life of the engine, at least one of the skirts portions, shown as only a single one of the skirt portions 26 in FIG. 5, and preferably at least the skirt portion on a thrust side of the piston 10, and also shown in FIGS. 1-4, by way of example and without limitation, as both skirt portions 26, have a recess 32, represented as being generally U-shaped, extending upwardly from a lowermost edge 34 of the skirt 26 and formed centrally to the skirt outer surface 30. The recesses 32 reduce the overall weight of the piston 10, reduced the potential friction generated against the cylinder wall, reduce the inertial forces generated in use, and improve the manufacturability of the piston 10.

The upper crown 16 of the piston 10 is represented here as having an upper surface 36 with a combustion bowl 38 recessed therein to provide a desired gas flow with the cylinder bore. An outer wall or ring belt 40 extends downwardly from the upper surface 36, with at least one annular ring groove 42 being formed in the ring belt 40 for floating receipt of a piston ring (not shown).

The lower crown 18 is represented here as being formed separately from the upper crown 16, such as in a forging process, and then joined thereto, wherein the upper and lower crowns 16, 18 can be joined together by a weld joint 44, for example. It should be recognized that a piston 10 constructed in accordance with the invention could have an upper and lower crown portions formed otherwise, such as in a casting process, for example, and that they could be joined using mechanisms other than a weld joint.

Figure 1:
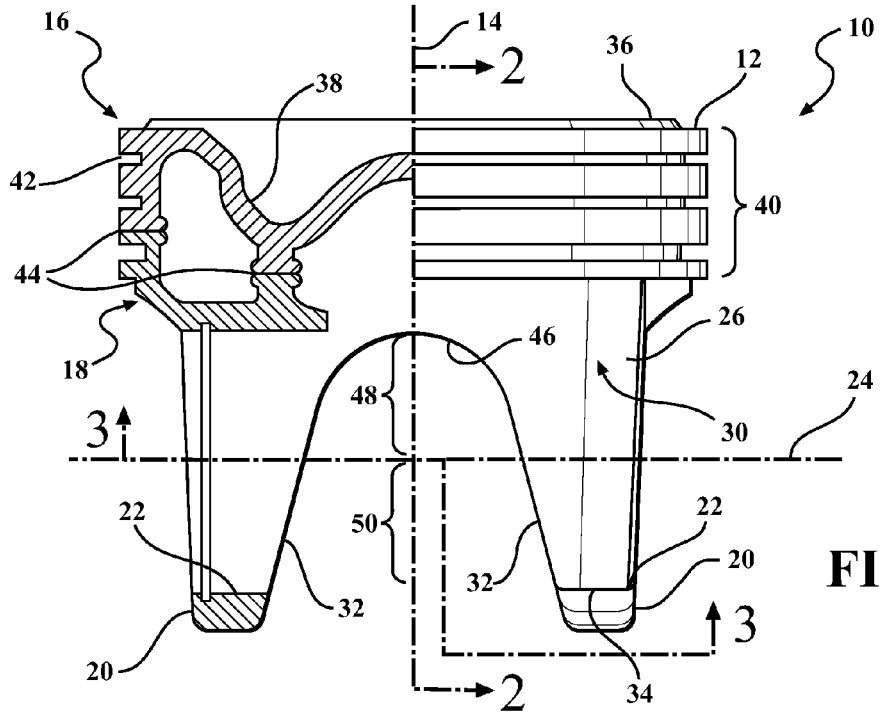
FIG. 1 is a partial cross-sectional view of a piston constructed according to one presently preferred embodiment of the invention.
Figure 2:
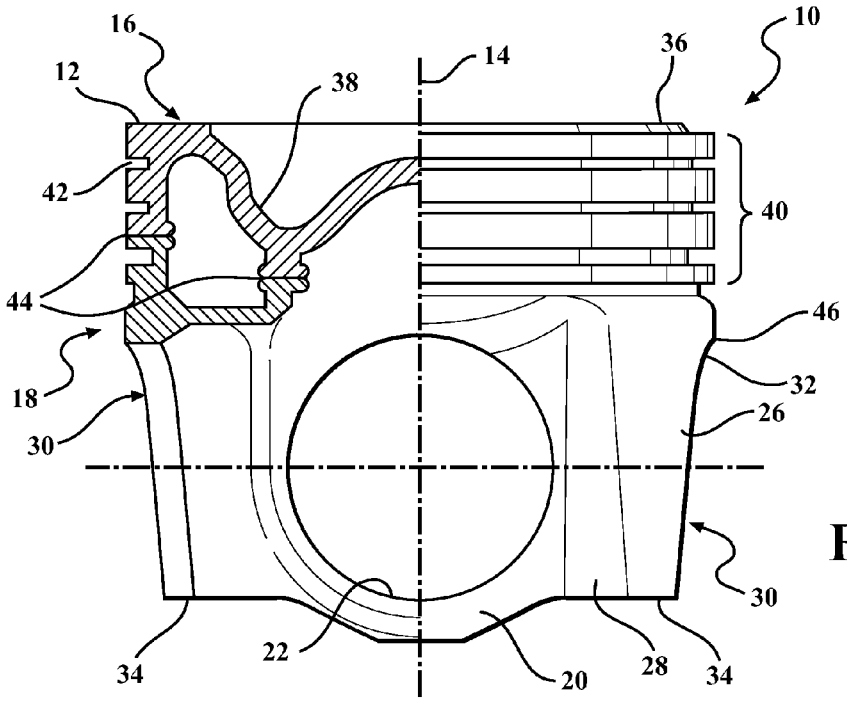
FIG. 2 is a cross-sectional view taken generally along the line 2-2 of FIG. 1.
Figure 3:
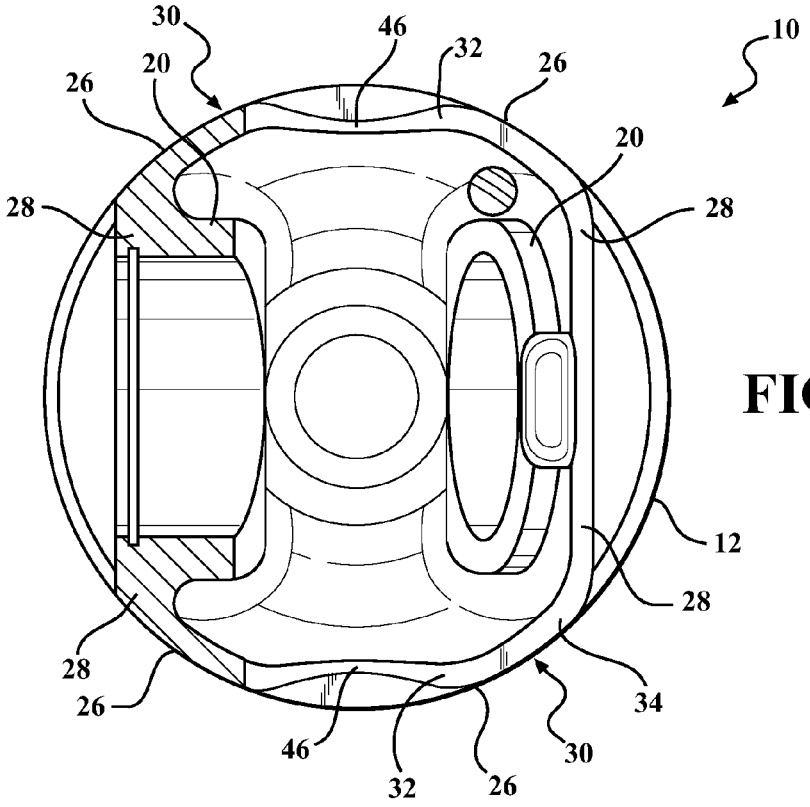
FIG. 3 is a cross-sectional view taken generally along the line 3-3 of FIG. 1.
Figure 4:
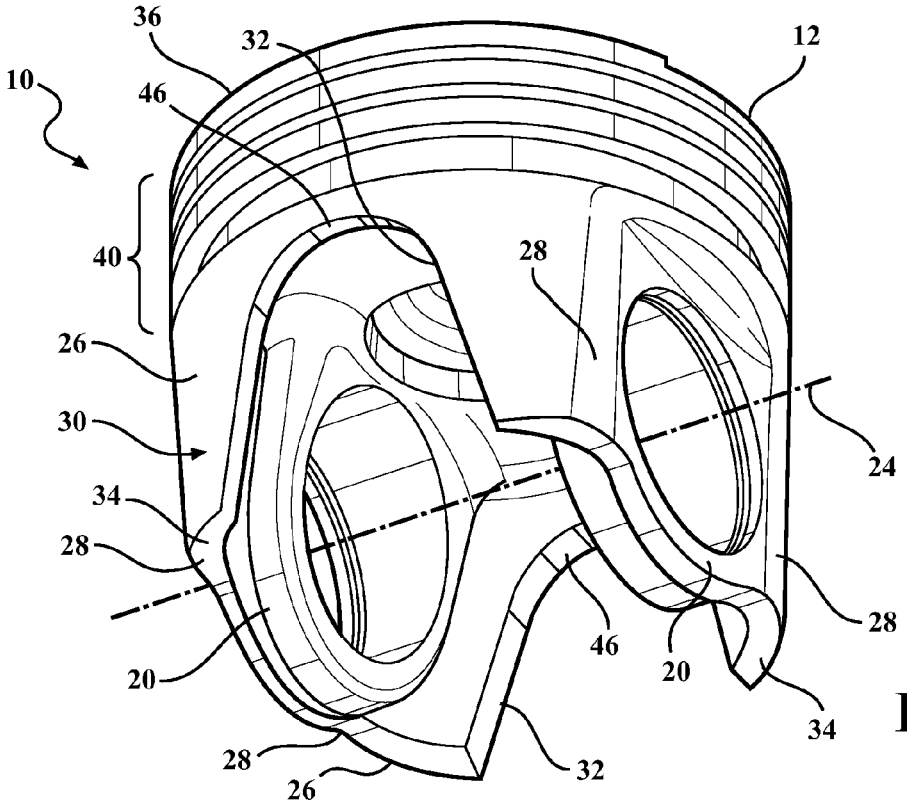
FIG. 4 is a bottom perspective view of the piston of FIG. 1.

As best shown in FIG. 1, to maximized the weight and friction reduction, the recesses 32 are shown as extending upwardly from the lowermost edge 34 beyond the central pin bore axis 24, by way of example and without limitation. The recesses 32 extend upwardly to an arcuate upper surface 46 that is shown as being substantially tangent to an upper most surface of the pin bores 22. As such, the height of the recess 32 is generally bisected by the central pin bore axis 24, with a frustoconical shaped portion 48 being below the central pin bore axis 24 and a generally U-shaped portion 50 being above the central pin bore axis 24. Accordingly, a widest portion of the recesses 32 is adjacent the lowermost edge 34 and a narrowest portion of the recesses 32 is adjacent the upper surface 46. It is contemplated that the recesses 32 could be otherwise shaped than as shown, such as with the sides of the recesses 32 being generally parallel to one another and being blended by a radius or filet to the upper surface 46, for example. Further, the height of the recesses 32 could be adjusted as desired for the intended application, and thus, could extend up to or below the central pin bore axis 24.

With the recesses 32 being open to the lowermost edge 34, manufacture of the skirt portions 26 is greatly simplified over skirts having circumferentially enclosed slits therein. With the recesses 32 being open, secondary operations, such as drill and/or milling for example, are not necessary, and thus, secondary operations can be reduced or eliminated. Further, with the recesses 32 occupying the central region of the skirt portions 26, the amount of material needing processing, such as forging, is greatly reduced. Further yet, the enlarged recesses 32 provide an enhance degree of flexibility to the pin bosses 20 in that the skirt portions 26 are more free to flex with the pin bosses 20 than if the recesses 32 were not provided. This allows the wrist pin joints between the pin bores 22 and the small end of the connecting rod (not shown) to flex as needed over a full stroke of the piston 10, thereby minimizing friction at the wrist pin joints and minimizing the risk of scuffing between the wrist pin and the pin bosses 20. Further yet, the recesses 32 minimize the contact area of the skirt portion outer surfaces 30 against the cylinder bore surface, thereby reducing the amount of friction generated between the skirt portions 26 and the cylinder bore surface.

Obviously, many modifications and variations of the present invention are possible in light of the above teachings. It is, therefore, to be understood that within the scope of the appended claims, the invention may be practiced otherwise than as specifically described.

What is claimed is:

1. A monobloc piston, comprising:

a piston body having an upper crown and a thrust side and an anti-thrust side;

a pair of pin bosses depending from said upper crown and having pin bores aligned with one another along a pin bore axis;

a pair of laterally spaced skirt portions fixedly attached to said pin bosses and extending between said pin bosses in a direction that is generally parallel with said pin bore axis, said skirt portions depending from said upper crown to a lowermost free edge with at least one of said skirt portions having a recess extending upwardly from said lowermost free edge beyond said pin bore axis and completely through from an exterior surface of said skirt portions to an interior surface thereof; and wherein said piston body has only a single one of said recesses and wherein said recess is on said thrust side of said piston body and said anti-thrust side does not have said recess.

2. The monobloc piston of claim 1 wherein said recess extends upwardly from the lowermost free edge into substantially tangent relation with an uppermost portion of the pin bores.

3. The monobloc piston of claim 2 the recess is generally U-shaped.

* * * * *